US006321398B1

(12) United States Patent
Wang

(10) Patent No.: US 6,321,398 B1
(45) Date of Patent: Nov. 27, 2001

(54) MULTIPURPOSE BODY-TURN-OVER APPARATUS

(76) Inventor: Yi-Lung Wang, 6th-Floor, No. 162, MAY Jin Road, Keelung City (TW)

( * ) Notice: Subject to any disclaimer, the term of this patent is extended or adjusted under 35 U.S.C. 154(b) by 0 days.

(21) Appl. No.: 09/545,506

(22) Filed: Apr. 7, 2000

(51) Int. Cl.[7] ..... A61G 7/10

(52) U.S. Cl. ..... 5/81.1 R; 5/83.1; 5/85.1; 5/87.1; 5/89.1; 212/901

(58) Field of Search ..... 5/81.1 R, 83.1, 5/85.1, 86.1, 84.1, 87.1, 88.1, 89.1, 915, 609; 212/281, 345, 901; 254/231; 1/609

(56) References Cited

U.S. PATENT DOCUMENTS

| | | | | |
|---|---|---|---|---|
| 274,527 | * | 3/1883 | Steele et al. | 5/87.1 |
| 1,961,119 | * | 5/1934 | Ettinger | 5/89.1 |
| 1,978,999 | * | 10/1934 | Jones | 212/901 X |
| 2,792,945 | * | 5/1957 | Brenny | 5/87.1 X |
| 3,998,284 | * | 12/1976 | James | 177/147 |
| 4,202,063 | * | 5/1980 | Murray | 5/87.1 |
| 5,068,931 | * | 12/1991 | Smith | 5/84.1 |
| 5,161,267 | * | 11/1992 | Smith | 5/88.1 |
| 5,195,726 | * | 3/1993 | Kaner | 212/901 X |
| 5,333,333 | * | 8/1994 | Mah | 5/87.1 |
| 5,406,658 | * | 4/1995 | Olkkonen | 5/83.1 |
| 5,511,256 | * | 4/1996 | Capaldi | 5/83.1 |
| 5,544,371 | * | 8/1996 | Fuller | 5/85.1 |
| 5,673,443 | * | 10/1997 | Marmor | 5/88.1 |
| 5,758,371 | * | 6/1998 | VanDyke et al. | 5/86.1 |
| 5,802,633 | * | 9/1998 | Capaldi | 5/86.1 |
| 5,934,490 | * | 8/1999 | Mora | 212/901 X |
| 5,946,478 | * | 9/1999 | Wang | 5/83.1 X |
| 6,035,465 | * | 3/2000 | Rogozinski | 5/83.1 |

* cited by examiner

*Primary Examiner*—Robert G. Santos
(74) *Attorney, Agent, or Firm*—Dougherty & Troxell

(57) ABSTRACT

A multipurpose body-turn-over apparatus mainly including an elevator, a driving mechanism, ropes, a net, suspension fittings, a vibrator, and a controller. The controller sets operating time and speed, and time pause at reverse of the apparatus, and the elevator is adjustable in height. The driving mechanism drives a displacement shaft of the driven assembly to move or rotate, so that ropes hanging from two ends of the driven assembly to connect the net are alternately pulled up and lowered, helping a patient lying on the net to regularly turn over or lie on side to avoid bedsore, or do rehabilitation exercises. The vibrator may alternately pull and lower ropes connected to two sides of the net at high frequency. The apparatus may be designed into heavy-duty or light models to meet different requirements and can be freely moved for use with different sickbeds.

8 Claims, 9 Drawing Sheets

MULTIPURPOSE BODY-TURN-OVER APPARATUS

BACKGROUND OF THE INVENTION

The present invention relates to a medical apparatus for turning a patient over on a sickbed, and more particularly to a multipurpose body-turn-over apparatus which uses a motor-driven assembly to pull or lower ropes having a net connected to lower ends thereof, so that a patient lying on the net can be automatically turned over regularly. Other treatment means may also be selectively connected to the ropes to help the patient do rehabilitation exercises, back exercises, etc.

There are many aged, sick, and invalid people lying on bed for a prolonged time and need nurses to regularly turn them over to avoid bedsore and other mental problem resulting from confinement to bed. There are automatic machines developed to help patients turn over and do rehabilitation exercises on sickbeds. Most of these sickbeds with such automatic machines include two lateral halves that are alternately lifted and lowered by motors or hydraulic cylinders to help patients turn over. However, patients' backs always keep close contact with the sickbeds when they are turned over with the help of inclined bed surfaces. Therefore, such sickbeds have only limited effect in preventing bedsore. Besides, these sickbeds with automatic machines to help patients turn over have complicate structure and are expensive. Not all the patients can afford to buy such a sickbed for use at home. Moreover, such sickbeds are usually designed for use by one single patient. The automatic machines are fixedly mounted on individual sickbeds and can not be freely moved to cooperate with multiple sickbeds for use in an economical manner.

To effectively solve the above-mentioned problems, the inventor has tried to develop an improved multipurpose body-turn-over apparatus based on but superior to a multipurpose body-turn-over apparatus disclosed in U.S. Pat. No. 5,946,748 granted to the same inventor.

SUMMARY OF THE INVENTION

It is therefore a primary object of the present invention to provide a multipurpose body-turn-over apparatus that can be freely moved for use with any sickbed to help a patient turn over on the sickbed and do rehabilitation exercises, back exercises, suspension treatment, etc.

Another object of the present invention is to provide a multipurpose body-turn-over apparatus that includes heavy-duty and light models to provide patients with more choices.

To achieve the above objects, the present invention mainly includes an elevator to which a driving mechanism is mounted. The driving mechanism includes a controller, a motor, a gearbox, a driven assembly, and an optional vibrator. Ropes are hung from two ends of the driven assembly. Limit switches are provided at predetermined positions in the travel of the driven assembly, so that ropes hung from two ends of the driven assembly are pulled upward or lowered alternately by the driving mechanism. A net is connected at two sides to lower ends of the ropes for a patient to lie thereon. Whereby when the ropes connected to two sides of the net are alternately pulled upward and lowered, the patient lying on the net is regularly turned over or assisted to do rehabilitation exercises.

In the heavy-duty model of the present invention, the driven assembly works in a linear movement and includes a screw stem connected at one end to the gearbox. An internally threaded collar is put around the screw stem for a displacement shaft to perpendicularly connect to the threaded collar. The displacement shaft and front and rear pulley supports separately mounted to two ends of the driven assembly are perpendicular to the driving mechanism with their two ends projected from two sides of the driving mechanism. Each end of the displacement shaft has two ropes connected thereto to extend in opposite directions. The ropes separately pass pulleys on two ends of the two pulley supports to hang down from four spaced points. (It is also possible for the ropes to hang down directly from the displacement shaft without passing the pulley supports and the pulleys, so that a net may be connected to the ropes by means of hooks.) The limit switches are preferably mounted at two ends and a middle point of the travel of the displacement shaft for the displacement shaft to reverse or reset when it moves to two outmost points or a middle point, respectively, in its travel.

In the light model of the present invention, the driven assembly works to rotate a displacement shaft and accordingly swing two pairs of arms on the displacement shaft. In this model, the driven assembly includes an internally threaded sleeve connected at a rear end to the gearbox and at a front end to a screw stem. When the sleeve is driven or rotated by the motor and the gearbox, the screw stem is driven to move forward or backward and therefore push or pull a push bar slidably connected to a front end of the screw stem. The push bar is connected at a root portion to the displacement shaft that extends perpendicularly to the screw stem with two ends thereof projected from two sides of the driving mechanism. Each end of the displacement shaft has two arms perpendicular to the displacement shaft and extending in opposite directions. Hangers are provided near outer ends of the arms for the ropes to hang therefrom. Upper, middle, and lower limit switches are provided outside and around the displacement shaft so that they can be touched by flanges correspondingly provided on the displacement shaft when the push bar is shifted. When the screw stem pushes or pulls the push bar, the displacement shaft is rotated and the arms connected to two ends of the displacement shaft swing like a seesaw. The upper, middle, and lower limit switches limit the angles within which the arms can swing. And, a vibrator is provided at a bottom of the driving mechanism to pull or lower another two ropes connected to the net at high frequency, so that the net is shaken quickly.

With these arrangements, the body-turn-over apparatus of the present invention can be freely moved to any desired position. When the driving mechanism is actuated, the driven assembly is driven to cause the net, which is connected to the lower ends of the ropes hanging from the driven assembly and has a patient lying thereon, to be alternately pulled upward or lowered at two sides for a desired time period, so that the patient lying thereon can be turned over leftward and rightward in a regular manner. Or, the ropes may be used to directly bind the patient's hands and/or feet and then be pulled or lowered to help the patient do rehabilitation exercises. And, the net shaken by the vibrator is helpful in preventing the patient from bedsore.

After the apparatus of the present invention is equipped with desired optional accessories, the elevator is adjusted to a desired height relative to the sickbed, and the net is connected to the ropes for use, the whole body-turn-over apparatus can be easily operated under instructions of doctor or professional personnel to achieve following purposes:

1. Spread a net made of pliable, air-pervious and washable material on a bed surface before letting a patient lie on the net. The net may have a size large enough to extend longitudinally from the patient's chest to buttocks and transversely from one side of the bed to another side thereof. Two flexible flat members are extended through two longitudinal sides of the net and fixed thereto. The flat members are flexible so as to match a raised head portion of the sickbed. There are spaced connecting holes formed on the flexible flat members for the ropes to connect thereto. When the ropes connected to two sides of the net are alternately pulled upward and lowered by a small distance, the patient can be turned over on the net repeatedly. Or, the net can be fixed to an inclined position for the patient to lie on the side to expose the patient's back to the air and avoid bedsore.

2. Two grip bars instead of a net may be connected to the ropes for the patient on the sickbed to grip or rest legs, so that the patient's hands, legs or knees may move along with the upward pulled or lowered ropes as doing a rehabilitation exercise.
3. Other medical treating means, such as fracture fixation means, may be connected to the ropes to help patient complete the skeletal traction.
4. It is a difficult work for a thin and small nurse to take care of a tall and big patient, especially when the nurse tries to clean the patient's back or replace a diaper for the patient. However, by manually setting the body-turn-over apparatus of the present invention, the patient lying on the net can turn over to lie on the side for the nurse to easily complete the back cleaning or changing diaper and the patient need only to be turned over twice. That is, turn the patient over once and release the net to clean the patient's buttocks; remove the used diaper away and spread a fresh and folded diaper beneath one buttock; turn the patient over again; unfolded the fresh diaper beneath another buttock; clean the buttocks again; and let the patient to lie on the back again and fix the diaper in place.
5. The apparatus of the present invention is equipped with a microcomputer to work in an automatic and timing manner. When the operating time period and speed are set for the apparatus, the patient lying on the net may lie on the side for a preset period of time and then automatically turn over to lie on the back or on the other side until the set time period is reached. By then, the patient will lie on the back and a music bell rings to alarm the nurse. Then, the apparatus may be removed from the sickbed to another place.
6. With the automatic and timing control manner of the present invention, the net connected to the ropes may be set to shake for a few seconds after its two sides have been alternately pulled or lowered for preset times. Or, the net may be set to sideward incline and shake alternately and each for a predetermined time period, so as to regularly turn over the patient and help the patient move his or her back at the same time.
7. The vibrator can be actuated to shake the connected ropes at high frequency. When the ropes controlled by the vibrator are connected to the patient's head or hands or feet, and the vibrator is adjusted to a required speed, it would help the patient do head and/or limb exercises.
8. The heavy-duty and light models can be selectively used to help patients of different weights. With the suspension hangers, the heavy-duty model of the present invention can also serve as a hoist to move the patient from one place to another in order to facilitate moving or cleaning of the sickbed.

BRIEF DESCRIPTION OF THE DRAWINGS

The structure and the operation of the present invention can be best understood by referring to the following detailed description of the preferred embodiments and the accompanying drawings, wherein.

DETAILED DESCRIPTION OF THE PREFERRED EMBODIMENTS

Figure 1:
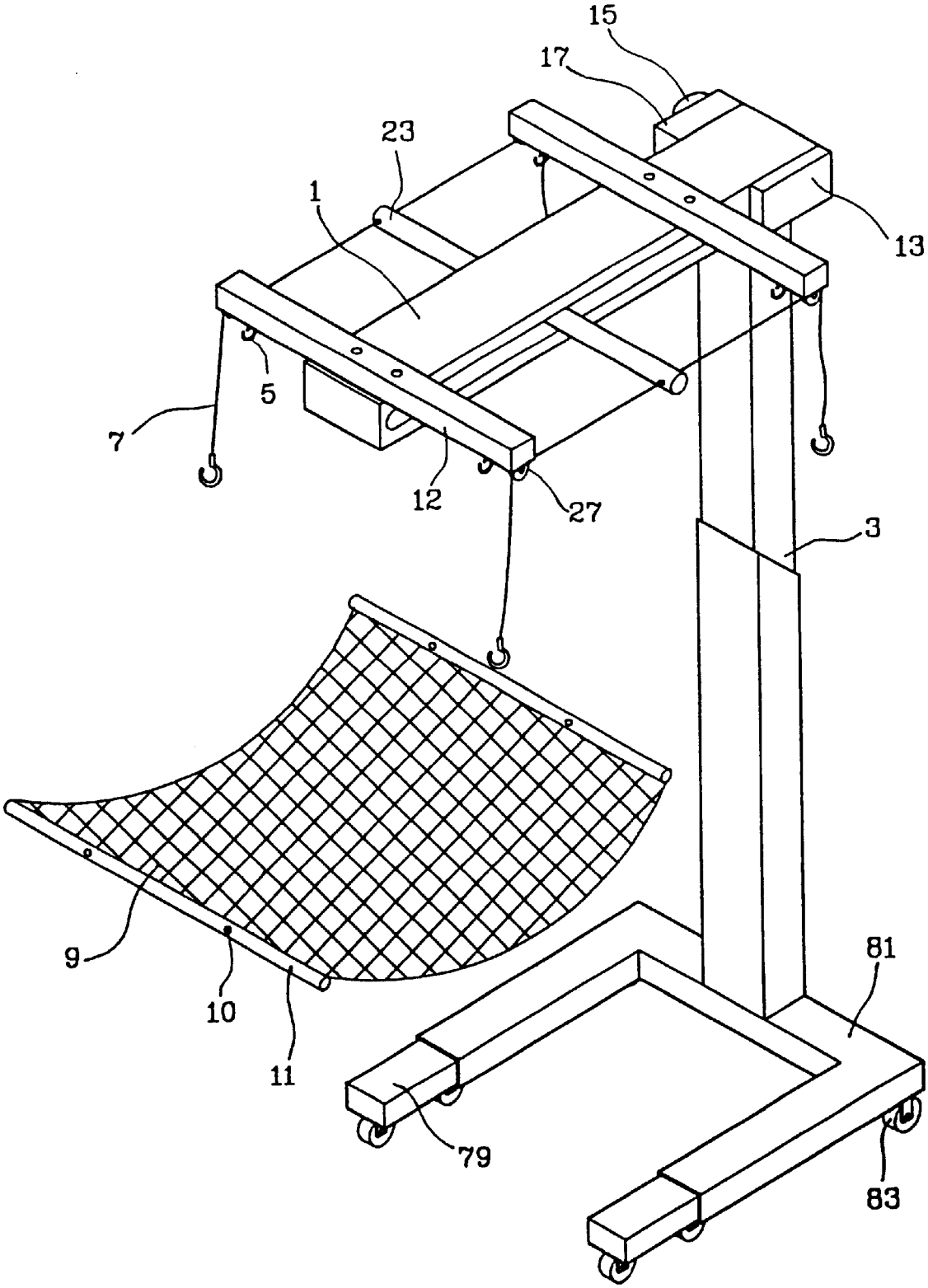
FIG. 1 is a perspective showing a heavy-duty model of the body-turn-over apparatus according to the present invention.

Please refer to FIG. 1 which is a perspective showing a heavy-duty model of a body-turn-over apparatus according to the present invention. In this model, the body-turn-over apparatus includes a driving mechanism 1 fixedly mounted to a top of an elevator 3. Four ropes 7 with hooks at their lower ends are separately hung from outer ends of two pulley supports 12 mounted on two ends of the driving mechanism 1. A net 9 is connected to the four ropes 7 by hooking the hooks at lower ends of the ropes 7 into connecting holes 10 provided on two flexible flat members 11 separately extending through two sides of the net 9. The elevator 3 maybe adjusted in its height, so that the ropes 7 are in properly tensed condition. The pulley supports 12 are provided with suspension hangers 5 and suspension straps (not shown), so that the apparatus may serve as a hoist to suspend a patient over the sickbed.

Figure 2C:
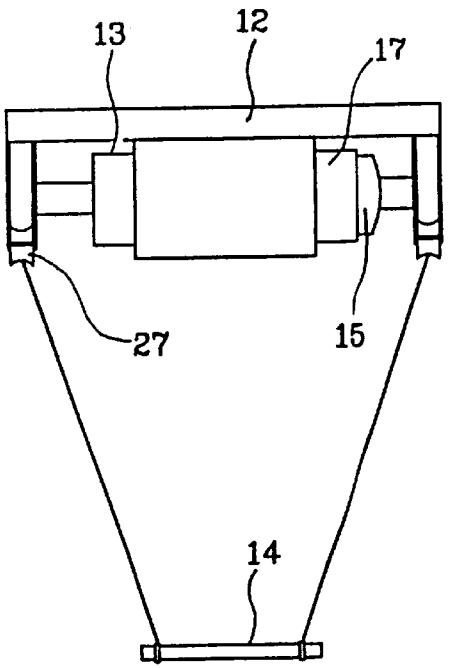
FIGS. 2A, 2B and 2C are top plan view, side sectional view, and front elevation, respectively, of the driving mechanism of the body-turn-over apparatus of FIG. 1.
Figure 2A:
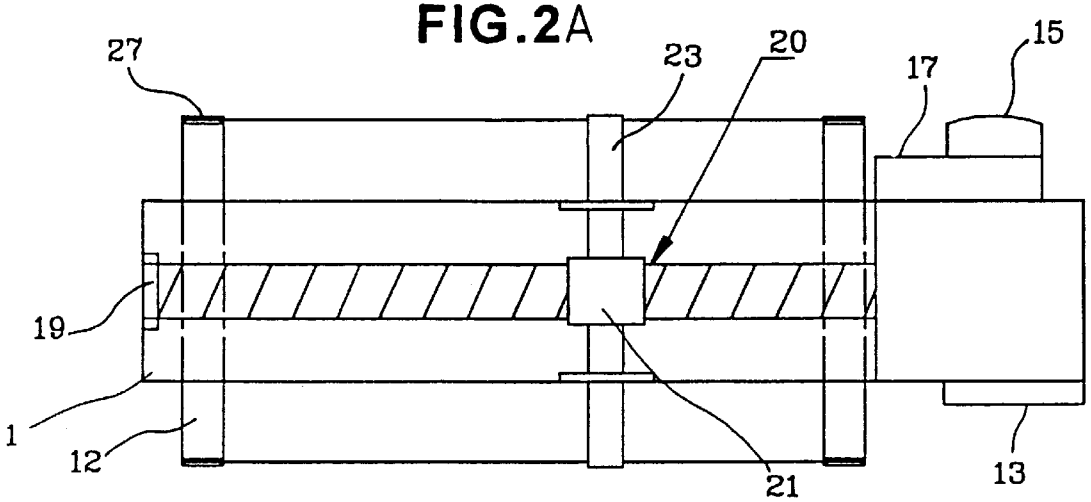
Figure 2B:
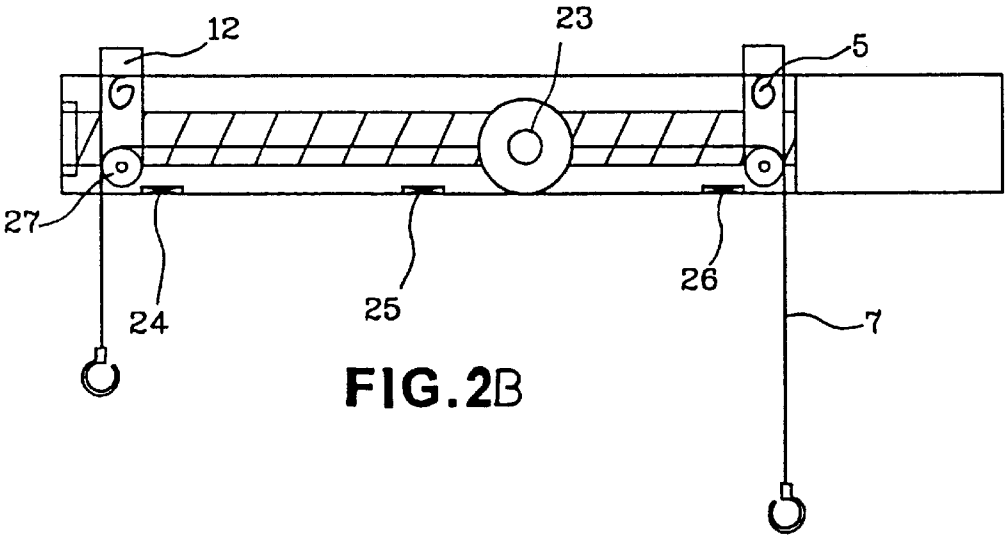

Please refer to FIGS. 2A to 2C. The driving mechanism 1 for the body-turn-over apparatus of heavy-duty model includes a controller 13. Commands may be given via the controller 13 to a motor 15 that in turn drives a driven assembly 19 via a gearbox 17. The driven assembly 19 includes a screw stem 20 around which an internally threaded collar 21 is mounted. A displacement shaft 23 is perpendicularly fixed to the collar 21. The displacement shaft 23 and the two pulley supports 12 all have two ends perpendicularly projected from two sides of a case of the driving mechanism 1. Each end of the displacement shaft 23 has two ropes 7 connected thereto to extend in opposite directions. The ropes 7 separately pass pulleys 27 mounted at two ends of the two pulley supports 12 to hang down from four spaced points. Alternatively, the ropes 7 are not routed via the pulleys 27 on the pulley supports 12 but are directly pulled outward to connect their hooks to the net 9. Left, middle, and right limit switches 24, 25, and 26 are provided in the case of the driving mechanism 1 within a travel of the displacement shaft 23 at predetermined suitable positions to respectively control the returning of the displacement shaft 23 to a middle position of its travel or the turning back of the displacement shaft 23 from utmost right and left ends of its travel.

Figure 3:
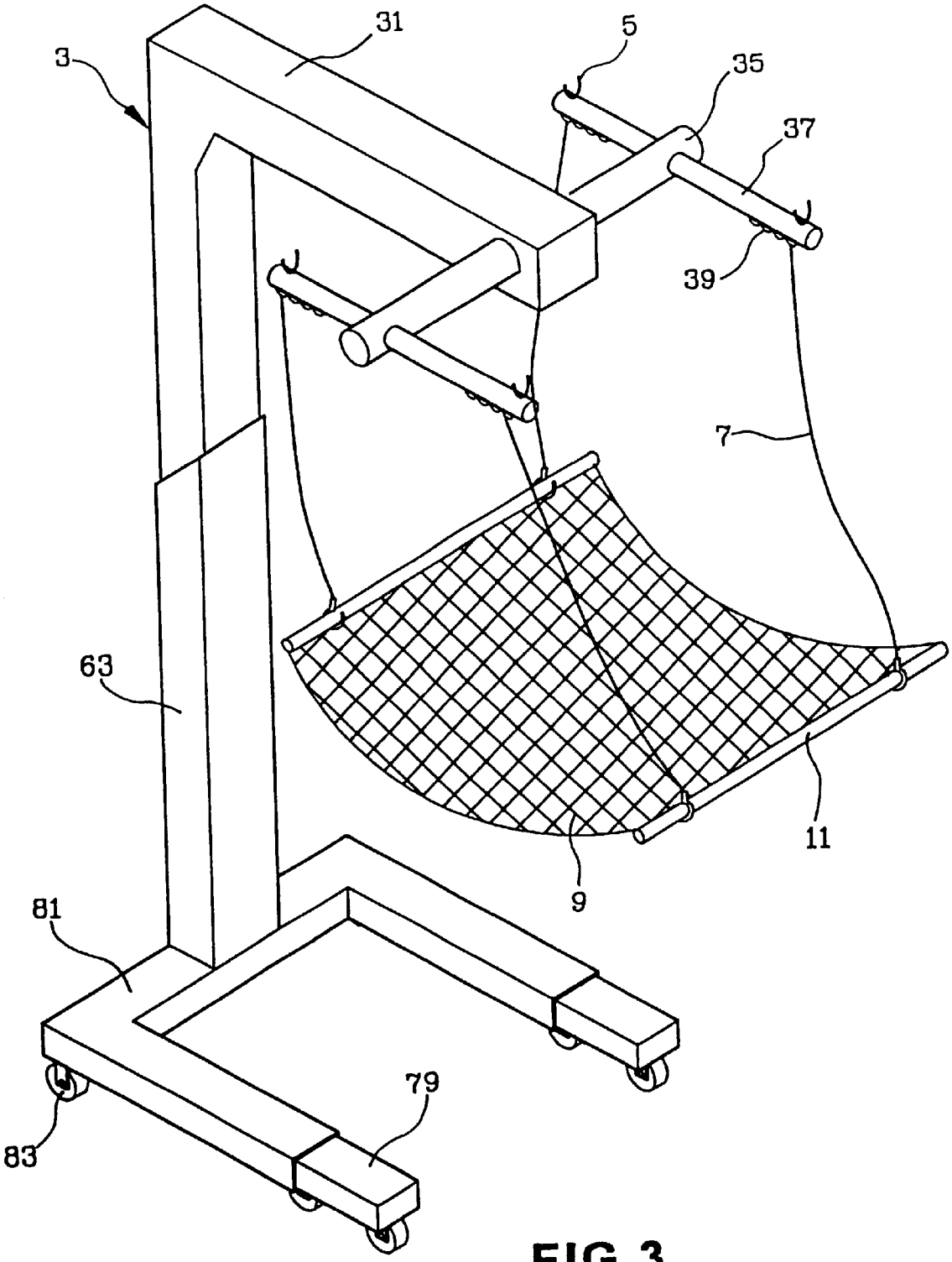
FIG. 3 is a perspective showing a light model of the body-turn-over apparatus according to the present invention.

FIG. 3 illustrates a light model of the body-turn-over apparatus of the present invention. In this model, the body-turn-over apparatus includes a driving mechanism 31 fixedly mounted to a top of an elevator 3. A displacement shaft 35 is transversely connected to a front end of a driven assembly 48. The displacement shaft 35 is provided at each outer end with two arms 37 perpendicular to and projected from the displacement shaft 35 in opposite directions. Each arm 37 is provided near a free end with a row of adequately spaced hangers 39. Ropes 7 symmetrically hang from the arms 37 with upper ends connected to four selected hangers 39 and lower ends to the flexible flat members 11 on the net 9. By symmetrically connecting the ropes 7 to different hangers 39 on the arms 37, the net 9 may have different stretching width. The arms 37 are also provided with suspension hangers 5 and suspension straps (not shown) for suspending a patient over the sickbed.

Figure 4C:
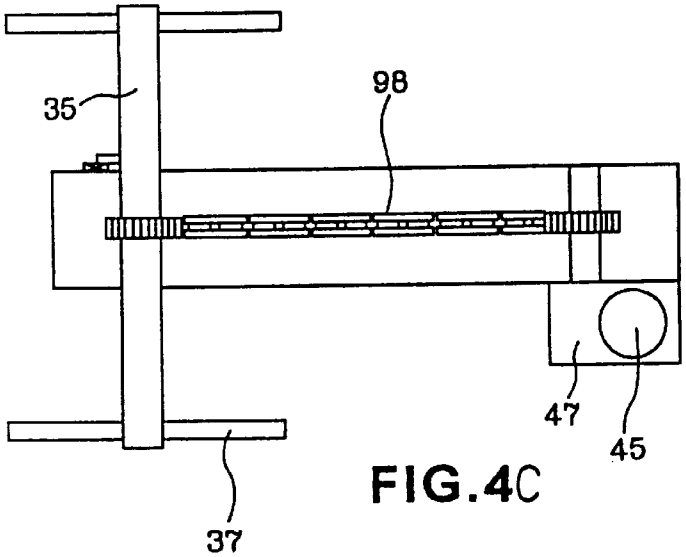
FIGS. 4A, 4*b,* and 4C are top plan view, side sectional view, and front elevation, respectively, of a first embodiment of the driving mechanism of the body-turn-over apparatus of FIG. 3.
FIG. 4D is a top view of a second embodiment of the driving mechanism of the body-turn-over apparatus of FIG. 3.
FIGS. 4E and 4F are top plan view and side sectional view, respectively, of a third embodiment of the driving mechanism of the body-turn-over apparatus of FIG. 3.
Figure 4D:
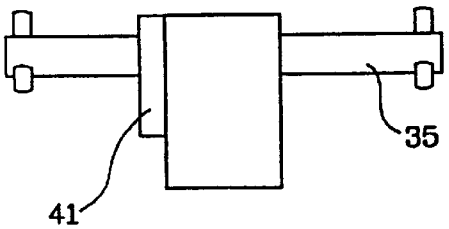
Figure 4A:
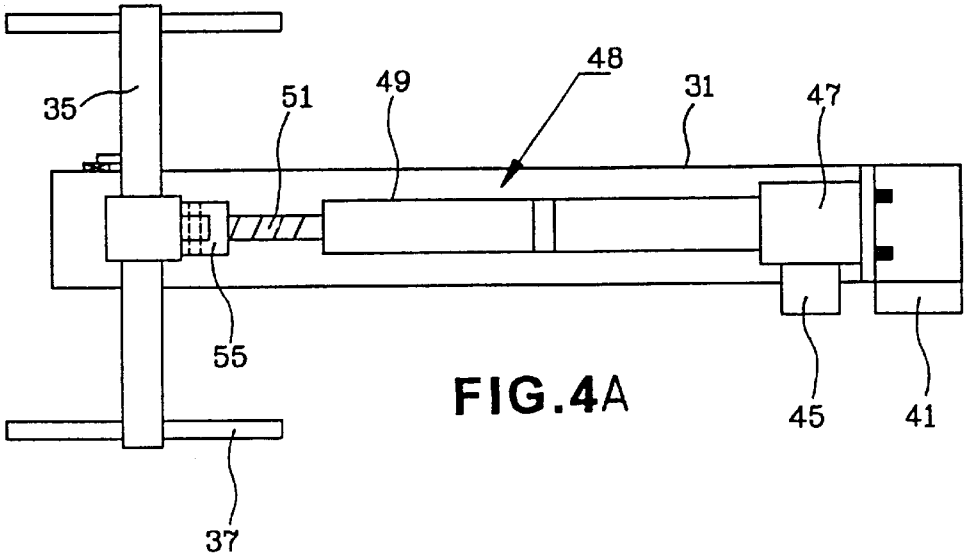
Figure 4B:
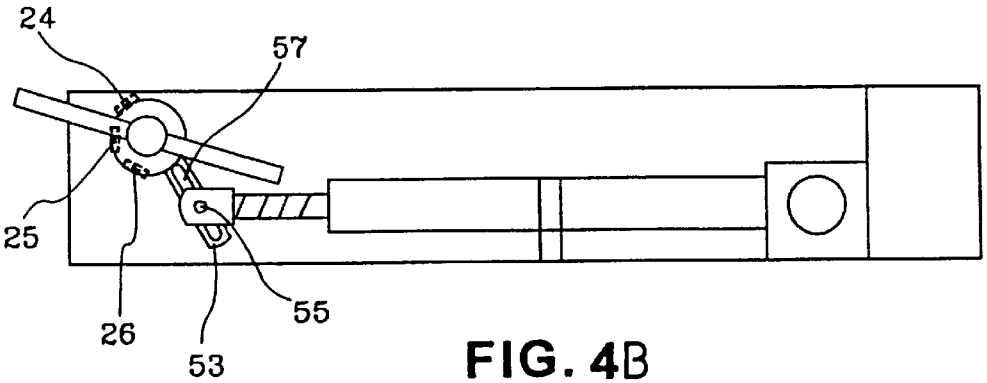
Figure 4E:
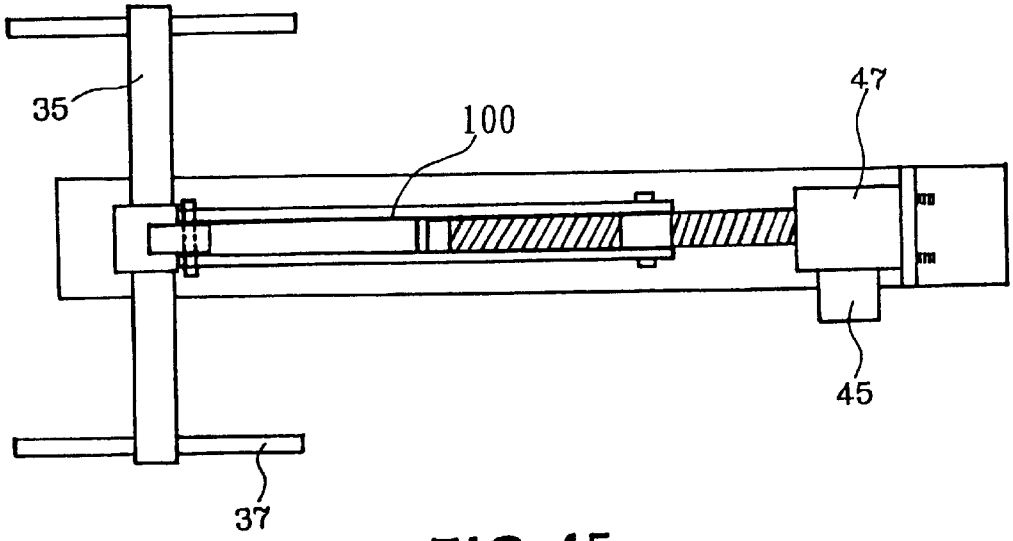
Figure 4F:
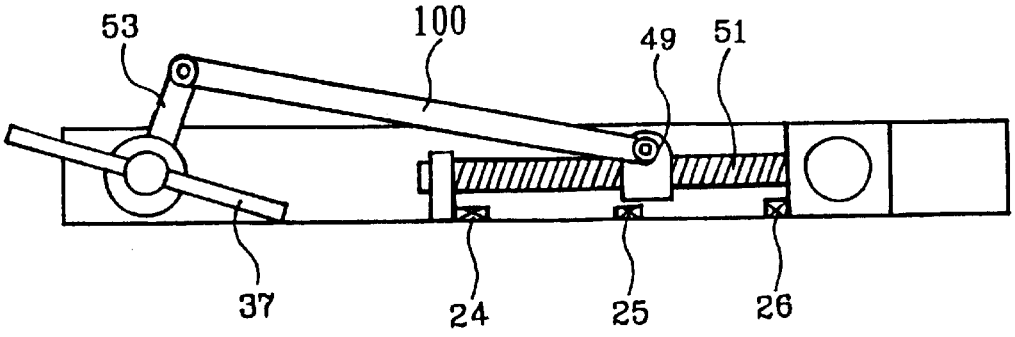

As shown in FIGS. 4A to 4C, he driving mechanism 31 of the body-turn-over apparatus of light model includes a controller 41. Commands may be given via the controller 41 to control a motor 45. After the motor 45 is reduced in speed via a gearbox 47, it may directly drives the displacement shaft 35 to rotate forward or backward, or indirectly drives the displacement shaft 35 through a driven assembly 48 (see FIGS. 4A to 4C), a chain gearing 98 (see FIG. 4D), or a crank 100 (see FIGS. 4E and 4F). The driven assembly 48 includes an internally threaded sleeve 49 which is rotated by starting the motor 45 and the gearbox 47 and a screw stem 51 axially mounted to a front end of the sleeve 49 is therefore caused to move forward or backward relative to the sleeve 49. (Alternatively, in the case of driving the displacement shaft with a crank 100 and a push bar 53, as shown in FIGS. 4E and 4F, the motor 45 and the gearbox 47 are actuated to rotate the screw stem 51 connected thereto, so that the threaded sleeve 49 mounted around the screw stem 51 is brought to move forward or backward relative to the screw stem 51.) A coupling head 55 is connected to a front end of the screw stem 51. A push bar 53 is fixedly connected at a root portion to a middle section of the displacement shaft 35, so that the displacement shaft 35 moves along with the push bar 53. The coupling head 55 is movable along a sliding slot 57 formed on the push bar 53. Whereby when the screw stem 51 is driven by the rotating sleeve 49 to move forward or backward, the coupling head 55 simultaneously slides in the sliding slot 57 to shift the push bar 53 forward or backward within ranges defined by three limit switches, namely, upper, middle, and lower limit switches 24, 25, and 26 provided outside and around the displacement shaft 35. When the push bar 53 shifts, it simultaneously brings the displacement shaft 35 to turn. At this point, the arms 37 at two sides of the displacement shaft 35 swing up and down like a seesaw to pull upward or lower the ropes 7 connected to the hangers 39, causing two sides of the net 9 to be lifted and lowered alternately in a regular manner.

Figure 5:
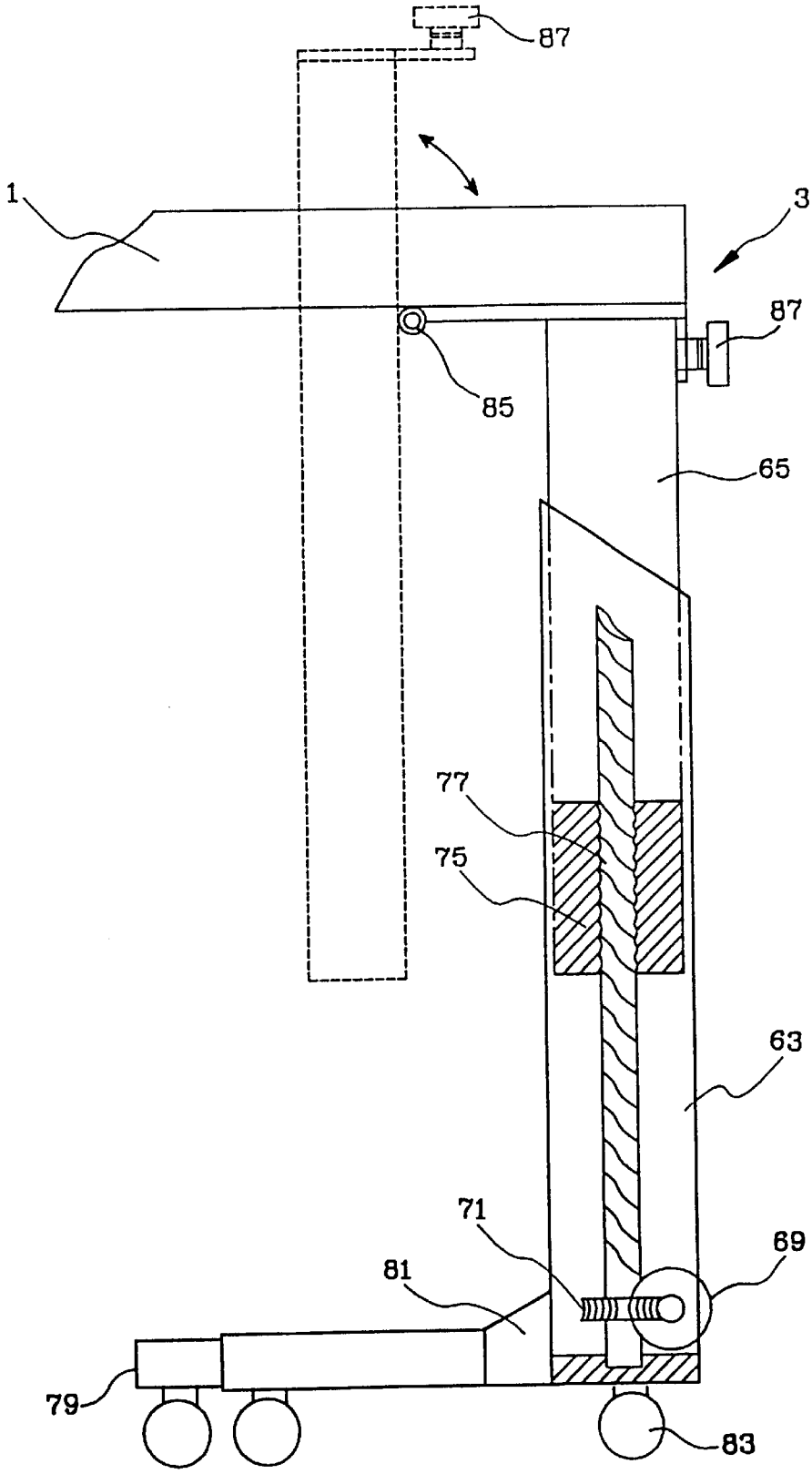
FIG. 5 is a side sectional view of the elevator of the body-turn-over apparatus of the present invention.

FIG. 5 is a side sectional view of the elevator 3 for the body-turn-over apparatus of the present invention. As shown, the elevator 3 includes a female case 63 put around a male case 65, an n-shaped stand formed from a middle longitudinal beam 81 and two transverse beams 79 fixed to two ends of the longitudinal beam 81, and four casters 83 separately mounted to bottom ends of the beams 79 and 81. A motor 69 and a gearbox 71 are mounted in the female case 63 at a lower portion thereof. After the motor 69 and the gearbox 71 are started, a screw stem 77 inside the elevator 3 is rotated to cause an internally threaded collar 75 put around the screw stem 77 to move up or down along the screw stem 77. Since the threaded collar 75 is fixed in the male case 65, the movement of the threaded collar 75 along the screw stem 77 brings the male case 65 to move up or down relative to the female case 63 at the same time. In the case of the heavy-duty model, the driving mechanism 1 may further include reversible ratchet wheels 85 and a locking screw 87 at predetermined positions. When the body-turn-over apparatus is not in use, the locking screw 87 may be loosened, so that the driving mechanism 1 can be pivotally turned about the reversible ratchet wheels 85 into a downward extended position in parallel with the elevator 3. And, when the body-turn-over apparatus is to be used, the driving mechanism 1 can be pivotally turned from the downward extended position to a position perpendicular to the elevator 3 and locked in place by tightening the screw 87 against the elevator 3.

Figure 6:
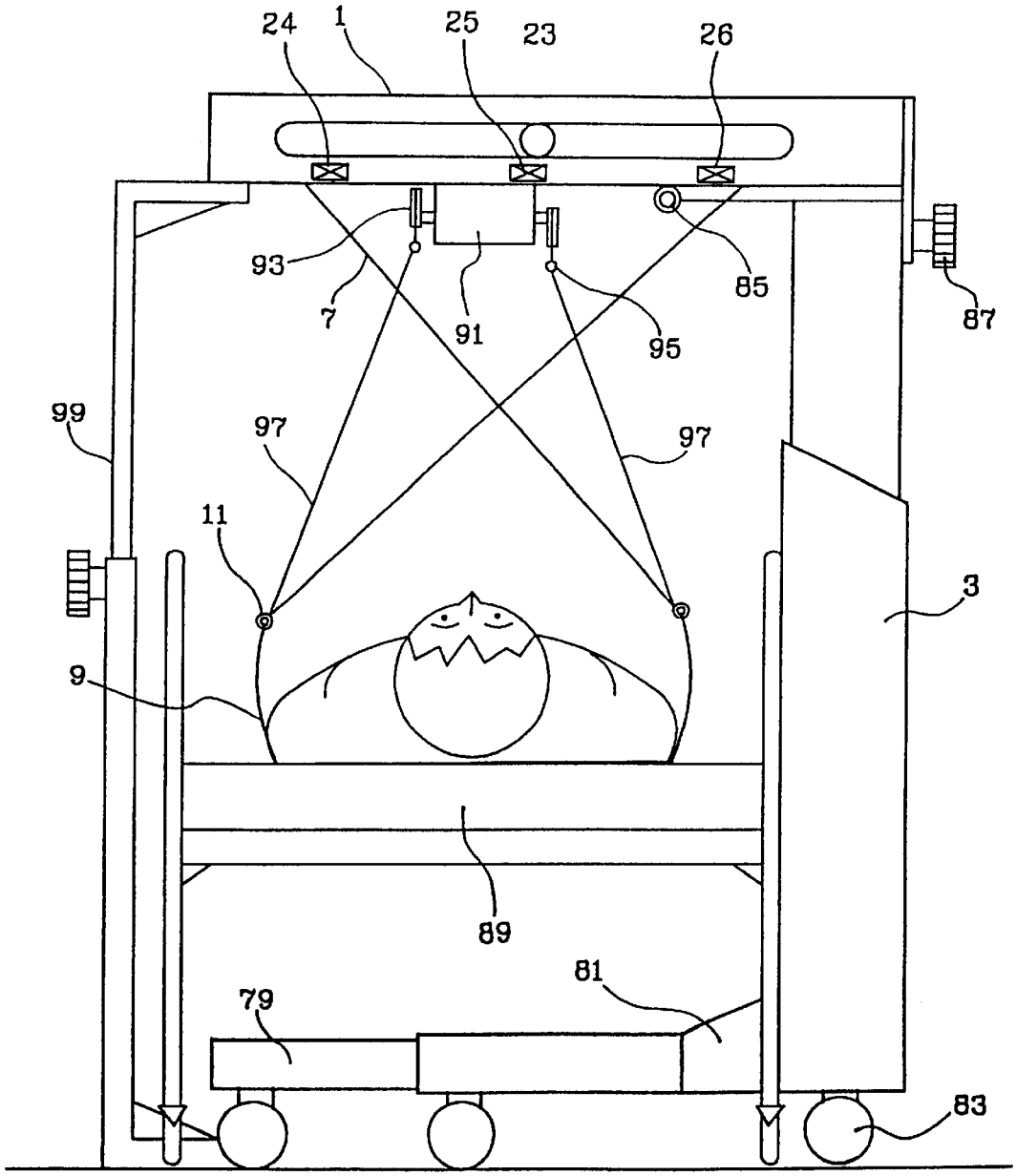
FIG. 6 schematically illustrates the clinical operation of the heavy-duty model of the present invention.

FIG. 6 schematically illustrates the heavy-duty body-turn-over apparatus of the present invention being employed to help a patient turn over on a sickbed 89. To do so, a washable net 9 is spread over the sickbed 89. Connect lower ends of the ropes 7 to the flexible flat members 11 at two sides of the net 9. Adjust the elevator 3 to a desired height relative to the sickbed 89, so that the ropes 7 are properly tensioned to decide an angular extent to which the patient is turned over on the sickbed 89. Then, the motor 15 is started and the displacement shaft 23 moves from the middle limit switch 25 toward the right limit switch 26. The displacement shaft 23 moves in reverse direction toward the left limit switch 24 when it touches the right limit switch 26. The displacement shaft 23 moves toward the right limit switch 26 again when it touches the left limit switch 24. The displacement shaft 23 reciprocates until a set time period is reached. The displacement shaft 23 will then return to its home position at the middle limit switch 25 and automatically stop moving. A speed at which the displacement shaft 23 is moved and a time period for which the displacement shaft 23 is paused at turning can both be set and adjusted via the controller 13. A vibrator 91 may be mounted to a bottom of the driving mechanism 1. The vibrator 91 includes two eccentric wheels 93 asymmetrically connected to two ends of a rotary shaft of a motor in the vibrator 91, two rings 95 separately connected to the two eccentric wheels 93, and two additional ropes 97 separately connected to the rings 95. When the motor of the vibrator 91 is started, the two eccentric wheels 93 would bring the rings 95 to rotate quickly and accordingly pull and lower the two ropes 97 alternately at high frequency. Lower ends of the two additional ropes 97 are connected to the net 9. The quickly alternated up and down motions of the two ropes 97 therefore bring the net 9 to shake at high frequency. The shaking net 9 is helpful in assisting a patient lying on the net 9 to turn over and do back and limb exercises. In the case of the heavy-duty model, an auxiliary support 99 including two telescopic sections may be mounted to an outer end of the driving mechanism 1 when a considerably heavy load is to be supported on the body-turn-over apparatus. The telescopic auxiliary support 99 may be manually adjusted to a height the same as that of the elevator 3 and be locked in place.

Figure 7:
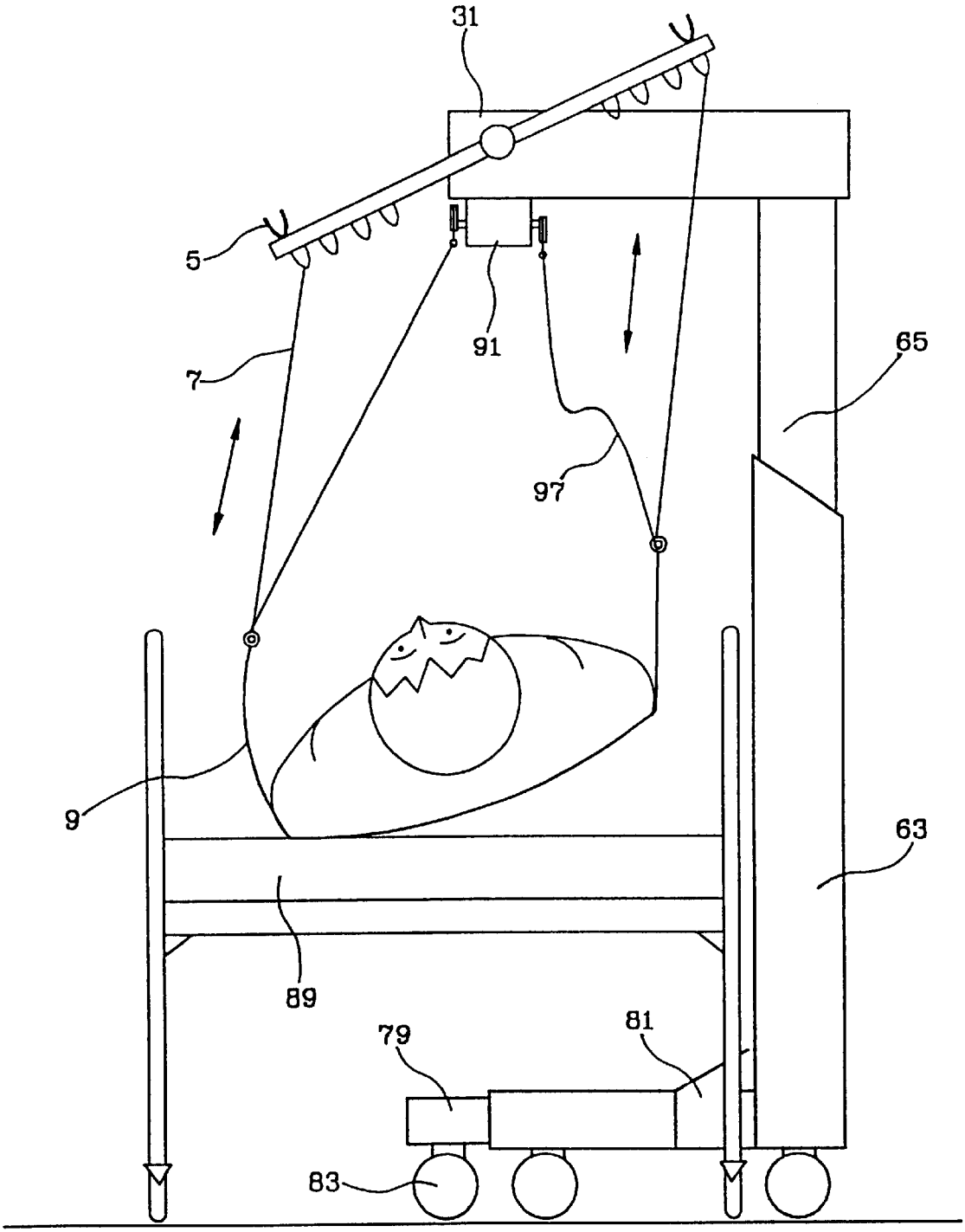
FIG. 7 schematically illustrates the clinical operation of the light model of the present invention.

FIG. 7 schematically illustrates the light model of the body-turn-over apparatus of the present invention being employed to help a patient turn over on a sickbed 89. When the arms 37 swing up and down to pull up or lower the ropes 7 relative to the sickbed 89, the net 9 connected at two foldable flat members 11 to the ropes 7 shall bring the patient lying on the net 9 to turn sideward to a desired extent. And when the vibrator 91 is actuated, the net 9 may be shaken at high frequency to help the patient moving his or her back. The clinical operation of the body-turn-over apparatus of light model is similar to that shown in FIG. 6 and is therefore not repeated herein.

Figure 8:
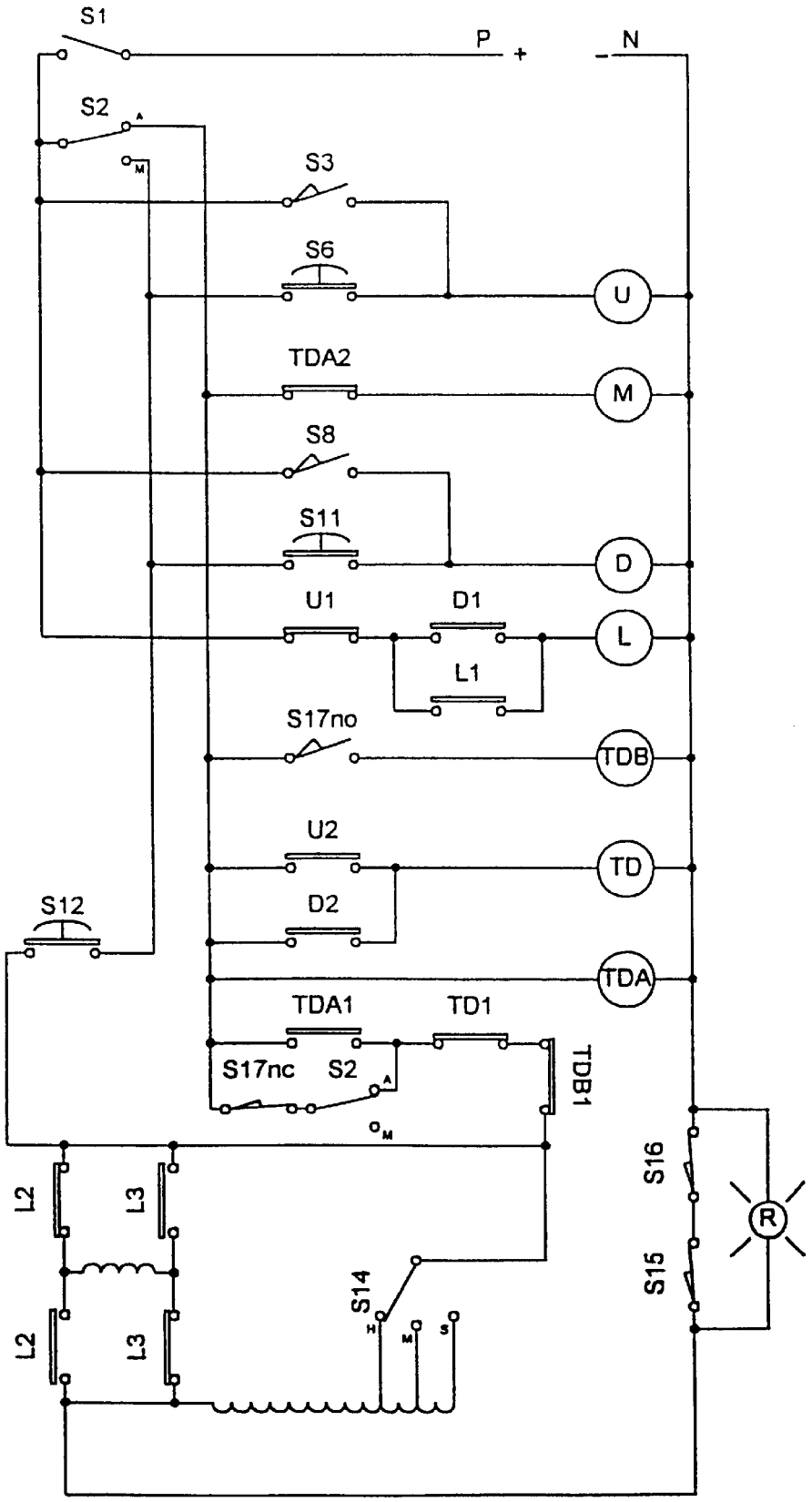
FIG. 8 is a control circuit diagram of the present invention.

FIG. 8 is a control circuit diagram for the body-turn-over apparatus of the present invention. The whole apparatus may also be powered by a rechargeable battery instead of an AC power source. As shown, the control circuit includes a power switch S1, an operation mode switch S2, a left (or upper) limit switch S3, a manual setting switch S6 for moving rightward, a right (or lower) limit switch S8, a manual setting switch S11 for moving leftward, an inching switch S12, a speed selection switch S14, a right-moving switch relay U, a left-moving switch relay D, a motor reversing relay L, a music bell relay M, a pause relay TD, a timer TDA, an exciting self-protective switch L1, a motor primary coil M1, a motor starting coil M2, and a middle pause relay TDB. The operation mode switch S2 allows an operator to select an automatic or a manual operation mode of the apparatus. When the apparatus is operated in the manual mode, the movement of the displacement shaft of the driven assembly is not limited by the middle limit switch.

A user may select to have the body-turn-over apparatus of the present invention automatically or manually operated.

To manually operate the body-turn-over apparatus, first switch the operation mode switch S2 to "M". Depress the setting switch S6 to select moving rightward or the setting switch S11 to moving leftward. Then, adjust the speed selection switch S14 to select a desired speed and depress the inching switch 12. At this point, the body-turn-over apparatus may operate inch by inch at the set speed and in the set direction.

To have the body-turn-over apparatus automatically operated, first switch the operation mode switch S2 to "A". In the case of heavy-duty body-turn-over apparatus, the displacement shaft 23 will automatically stop at a middle point of its travel. Adjust the speed selection switch S14 to set a desired speed and the pause relay TD to set time of pause before the displacement shaft 23 moves in an opposite direction. Finally, set the timer TDA to a desired operation time period. Then, the displacement shaft 23 of the body-turn-over apparatus starts to move (or rotate) between the left (or upper) limit switch S3 and the right (or lower) limit switch S8 until the set operation time is reached. At this point, the apparatus is automatically reset to a middle positioning switch S17 and the displacement shaft 23 stops at the middle point of its travel. Meanwhile, a music bell is caused to ring.

Alternatively, the controller 13 or 41 may be so designed that an operating time of the motor controlled or adjusted by a microcomputer can be counted and converted into a moving distance of the displacement shaft 23 or a swing angle of the arms 37 caused by the driving mechanism 1 or 31, respectively. Whereby, whenever the displacement shaft 23 or 35 are moved or rotated to a middle inductive switch, the controller of the apparatus is automatically reset to zero and the counting of the operating time starts from zero again. The left (upper) and the right (lower) limit switches 24, 25 can be replaced and the travel of the displacement shaft 23 can be adjusted by the control of the microcomputer over the motor of the driving mechanism.

The net 9 being laid over the sickbed 89 is preferably made of pliable, air-pervious and washable material. The flexible flat members 11 are preferably fixed to two longitudinal sides of the net 9. Connecting holes 10 for connecting the ropes 7 to the net 9 are preferably spaced on the flexible flat members 11 near middle portions thereof, so that a patient lying on the net 9 may be indirectly brought to a suspended position above the sickbed.

Alternatively, two grip bars or rings 14 may be connected to the ropes 7 at two sides of the sickbed 89, so that a patient lying on the sickbed may grip the bars or rings 14 or rest two legs in the rings 14 to do rehabilitation exercises. Or, the ropes 7 may be associated with fracture fixation means for necessary skeletal traction, with a set of suspension fittings to suspend the patient above the sickbed, or with a set of vibrating straps to help the patient move his or her head and limbs.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A multipurpose body-turn-over apparatus for movably locating beside a sickbed to help turning over or moving a patient on said sickbed, comprising a height-adjustable elevator, and a driving mechanism mounted to a top of said elevator; said driving mechanism including a controller, a motor, a gearbox, a driven assembly, limit switches provided within a travel of said driven assembly at predetermined positions, and a vibrator; said driven assembly having ropes hung from two ends thereof and lower ends of said ropes being provided with hooks for connecting to two sides of a net thereto; said driven assembly being directly driven by said motor and said gearbox to move in manners decided by commands given to said motor by said controller and within a distance defined by said limit switches, said driven assembly when being driven by said motor causing said ropes hung from said two ends thereof to alternately ascend or descend and therefore making said net to incline alternately between said two sides; said vibrator being mounted at a bottom of said driving mechanism and having two ropes hung therefrom to connect at lower ends thereof to said two sides of said net, such that said two sides of said net may be alternately pulled or lowered at high frequency; and said driven assembly being selectively provided with other medical treating means for suspending the patient over said sickbed when necessary.

2. A multipurpose body-turn-over apparatus as claimed in claim 1, wherein said driven assembly is driven by said motor to cause a displacement shaft thereof to move in a linear movement, and wherein said driven assembly includes a screw stem connected at a rear end to said gearbox and rotated by said motor, an internally threaded collar fixed around said screw stem, said displacement shaft being perpendicularly fixed on said threaded collar, and two pulley supports separately and perpendicularly mounted at front and rear ends of said driven assembly, said displacement shaft and said pulley supports all having two ends projected from two sides of said driving mechanism, said ropes hung from said driven assembly being separately connected to two sides of said two ends of said displacement shaft with their free ends extending from said displacement shaft in opposite directions to pass four pulleys provided at said two ends of said pulley supports and hang down therefrom, and said limit switches being preferably mounted at said two ends and a middle point of the travel of said displacement shaft to define positions for said displacement shaft to move reversely or to return to the middle point of its travel when said driving mechanism is disabled.

3. A multipurpose body-turn-over apparatus as claimed in claim 1, wherein said driven assembly is driven by said motor to cause a displacement shaft thereof to turn forward and backward relative to said travel of said driven assembly, and wherein said driven assembly includes an internally threaded sleeve connected at a rear end to said gearbox and at a front end to a screw stem, and a push bar slidably connected at a free end to a front end of said screw stem and fixedly connected at a root portion to said displacement shaft that extends perpendicularly to said driven assembly; two ends of said displacement shaft projected from two sides of said driving mechanism and each having a pair of arms perpendicularly connected thereto and extended in opposite directions, said arms having hangers provided near outer ends thereof for said ropes of said driven assembly to hang therefrom.

4. A multipurpose body-turn-over apparatus as claimed in claim 1, wherein said driven assembly is driven by said motor to cause a displacement shaft thereof to turn forward and backward relative to said travel of said driven assembly, and wherein said driven assembly includes a screw stem connected at a rear end to said gearbox and being driven to rotate by said motor, an internally threaded collar mounted around said screw stem to move forward or backward along said screw stem when the latter is rotated, said displacement shaft being indirectly connected to said threaded collar via a push bar connected at one end to said displacement shaft and at the other end to one end of a crank of which the other end is connected to said threaded collar.

5. A multipurpose body-turn-over apparatus as claimed in claim 1, wherein said driven assembly is driven by said motor and said gearbox according to commands given to said motor by said controller to directly cause a displacement shaft of said driven assembly to turn forward and backward relative to said travel of said driven assembly.

6. A multipurpose body-turn-over apparatus as claimed in claim 1, wherein said driven assembly is driven by said motor and said gearbox according to commands given to said motor by said controller to rotate a transmission chain of said driven assembly and thereby cause a displacement shaft connected to said transmission chain of said driven assembly to turn forward and backward relative to said travel of said driven assembly.

7. A multipurpose body-turn-over apparatus as claimed in claim 1, wherein said controller includes a microcomputer that may not only control and adjust an operating time of said motor of said driving mechanism, but also count and convert said operating time of said motor into data showing said travel of said driven assembly, whereby whenever said driven assembly is moved to one of said limit switches located at a middle point of its travel, said controller is automatically reset to zero and counts the operating time of said motor from zero again, such that said limit switches located at said two ends of said driven assembly can be omitted and distances of leftward and rightward displacements of said driven assembly in operation can be adjusted.

8. A multipurpose body-turn-over apparatus as claimed in claim 1, wherein said driven assembly is driven by said motor to cause a displacement shaft thereof to move in a linear movement, and wherein said driven assembly includes a screw stem connected at a rear end to said gearbox and rotated by said motor, an internally threaded collar fixed around said screw stem, and said displacement shaft being perpendicularly fixed on said threaded collar; said ropes of said driven assembly being separately connected to two ends of said displacement shaft to hang down therefrom, and a net being connected to lower ends of said ropes by means of hooks, whereby when said screw stem is rotated, said internally threaded collar mounted around said screw stem is moved to cause said displacement shaft to shift rightward and leftward alternately relative to said travel of said driven assembly and thereby pull said ropes to upward and downward alternately.

* * * * *